US007050594B2

(12) United States Patent
Nakada et al.

(10) Patent No.: US 7,050,594 B2
(45) Date of Patent: May 23, 2006

(54) SOUND CONTROL UNIT AND SOUND SYSTEM

(75) Inventors: Tsuyoshi Nakada, Tokyo (JP); Teruho Yamada, Tokyo (JP); Susumu Fujiwara, Tokyo (JP); Noboru Kyouno, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 302 days.

(21) Appl. No.: 10/201,913

(22) Filed: Jul. 25, 2002

(65) Prior Publication Data

US 2003/0021427 A1 Jan. 30, 2003

(30) Foreign Application Priority Data

Jul. 25, 2001 (JP) ..... 2001-224854

(51) Int. Cl.
*H04R 3/00* (2006.01)

(52) U.S. Cl. ..... 381/96; 381/58; 381/59

(58) Field of Classification Search ..... 381/96, 381/58–59

See application file for complete search history.

(56) References Cited

U.S. PATENT DOCUMENTS

| | | | | |
|---|---|---|---|---|
| 5,009,281 A * | 4/1991 | Yokoyama | ..... | 381/96 |
| 5,197,104 A * | 3/1993 | Padi | ..... | 381/96 |
| 5,542,001 A * | 7/1996 | Reiffin | ..... | 381/96 |
| 5,588,065 A * | 12/1996 | Tanaka et al. | ..... | 381/96 |

FOREIGN PATENT DOCUMENTS

| | | |
|---|---|---|
| JP | 5-183978 A | 7/1993 |
| JP | 11-215587 A | 8/1999 |
| JP | 2000-287293 A | 10/2000 |

* cited by examiner

*Primary Examiner*—Laura A. Grier
(74) *Attorney, Agent, or Firm*—Birch, Stewart, Kolasch & Birch, LLP

(57) ABSTRACT

A motional feedback (MFB) signal control unit includes a vibration displacement calculating part which generates a vibration displacement detecting signal in response to the input of a vibration detecting signal from a vibration detecting coil of a speaker unit, a vibration speed calculating part which generates a vibration speed detecting signal in response to the input of the vibration detecting signal, a processed signal generating part which generates a feedback signal in response to the input of the vibration displacement signal and the vibration speed detecting signal, and an adder which adds the feedback signal to a sound signal outputted from a sound reproducing unit so as to input the sound signal to a driving voice coil of the speaker unit.

7 Claims, 7 Drawing Sheets

SOUND CONTROL UNIT AND SOUND SYSTEM

BACKGROUND OF THE INVENTION

1. Field of the Invention

This invention relates to a sound control unit and a sound system.

2. Description of Related Art

FIG. 5 is a schematic diagram showing an example in which a bus is mounted with a conventional sound system. In FIG. 5, reference numeral 101 denotes a body of the bus, reference numeral 102 a ceiling of the bus, reference numeral 103 right and left racks disposed under the ceiling 102, reference numeral 104 right and left speaker systems disposed on the respective racks 103, reference numeral 105 speaker units and reference numeral 106 a sound reproducing unit for inputting a sound signal to the speaker units 105.

FIGS. 6A and 6B are schematic drawings showing a double driving type speaker system and a single driving type speaker system, respectively, of the speaker system 104. FIG. 6A shows a double driving type speaker system 104A having two spaces therein.

Referring to FIG. 6A, reference numeral 105A denotes two front-radiating speaker units, reference numeral 105B an auxiliary speaker unit, reference numeral 120A a closed inner space required for disposing therein and driving the front-radiation speaker units 105A, and reference numeral 120B a closed inner space or an inner space having an open plane required for disposing therein and driving the auxiliary speaker unit 105B.

FIG. 6B shows a single driving type speaker system 104B having a single space volume therein. Referring to FIG. 6B, reference numeral 105C denotes two front-radiation speaker units, and reference numeral 120C a closed inner space required for disposing therein and driving the front-radiation speaker units 105C.

Each of the speaker units 105A, 105B, and 105C is provided with a driving voice coil and a magnetic circuit for driving a diaphragm in response to the inputted sound signal.

FIG. 7 is an internal block diagram showing the configuration of the sound reproducing unit 106 in FIG. 6. Referring to FIG. 7, reference numeral 107 denotes a selector for selecting a sound source signal outputted from a sound source, reference numeral 108 an amplifier for amplifying the selected sound source signal and outputting the sound signal, and reference numeral 109 a plurality of driving voice coils provided for the respective speaker units for inputting the sound source signal outputted from the amplifier 108.

The operation of the conventional sound reproducing unit will be described.

Although the speaker system inside the bus is, as shown in FIG. 5, a stereo type arranged on the right and left sides, the operation of one speaker system will be described for the sake of simplicity. Various kinds of sound source signals (TUNER, TAPE, CD, AUX) from a tuner, a cassette tape player, a compact disc (CD) player, and other sound source devices are inputted to the selector 107 in FIG. 7. The selector 107 selects one sound source out of various kinds of sound sources in accordance with the selecting operation and inputs it to the amplifier 108. The amplifier 108 amplifies this sound source signal to output it as a sound signal (AS), and inputs it to the driving voice coil 109 of each of the speaker units.

In case of the double driving type speaker system 104A, the sound signal inputted to the driving voice coils 109 of the two front-radiating speaker units 105A vibrates the diaphragm coupled to a bobbin to which the driving voice coil 109 is fixed, thereby radiating a sound to the front. Further, the sound signal inputted to the driving voice coil 109 of the auxiliary speaker unit 105B radiates the sound to the rear of the front-radiating speaker units 105A so as to complement the vibrations of the front-radiating speaker units 105A. As a result, in the double driving type speaker system 104A, the front-radiating speaker units 105A inside the closed inner space 120A radiate bass enhanced by the aide of the radiation from the auxiliary speaker unit 105B inside the closed inner space 120B.

On the other hand, in case of the single driving type speaker system 104B, the sound signal inputted to the driving voice coils 109 of the two front-radiating speaker units 105C vibrates the diaphragm coupled to the bobbin to which the driving voice coil 109 is fixed, thereby radiating a sound to the front. That is, in the single driving type speaker system 104B, the sound is radiated only by the front-radiating speaker units 105C inside the closed inner space 120C having a closed inner space or an opening plane.

In any driving type speaker systems, the closed inner space virtually determines the minimum resonance frequency and the steepness of the resonance characteristics which define the limit of bass reproduction, and those members of different kind of diaphragm and the supporting system which constitute the speaker unit, as well as by the member constants determines the treble characteristics.

FIG. 8 is a graph showing examples of the sound characteristics of the speaker system in the sound system for a bus. In FIG. 8, the characteristic curve F1 on the upper side represents an output sound pressure frequency characteristic, and the characteristic curve Z1 on the lower side represents an impedance characteristic having the output sound pressure frequency characteristic. In FIG. 8, the frequency f0 is the limit of the minimum resonance frequency at which the bass is reproducible, and the steepness of the resonance frequency is generally called as a Q factor.

The conventional sound system thus arranged as described above, in case of the double driving type speaker system, needs the auxiliary speaker for enhancing the bass in addition to the two front-radiating speaker units. Further, the speaker cabinet has the closed inner space for the auxiliary speaker unit in addition to that for the front radiating speaker units, which complicates the structure of the speaker cabinet, bringing about an increase in the cost of the sound system.

In addition, the auxiliary speaker unit succeeds in synchronization (following-up) in the same phase in the vibration-sound radiating region relating to the bass reproduction of the front-radiating speaker units. In the vibration-sound radiating region relating to the treble reproduction, however, the auxiliary speaker unit fails in synchronization in the same phase with the increase in the number of vibrations. In this kind of frequency region in which synchronization cannot accomplish, once it comes to the worst vibrating conditions, the vibration amplitude of the auxiliary speaker unit becomes antiphase to the vibration amplitude of the front-radiating speaker units, resulting in the occurrence of distortion in sound. Further, a gain in the weight of the speaker system causes an increase in the cost of the bus itself and the specific fuel consumption of the bus resulting from the fortification, or the like, as a measure to be taken for safety.

On the other hand, in case of the single driving type speaker system, it is necessary to widen the closed inner space in order to attain good bass reproduction characteristics. As a result, the speaker cabinet becomes large in size and weight, a rate of the occupied volume inside the bus becomes large, and the cost of the bus itself and the specific fuel consumption of the bus increase due to the fortification, or the like, as a measure to be taken for safety. Even in case the speaker unit is a so-called bass-reflex (bass reflection) type having a partial opening so as to make the inner space smaller to a certain degree, the structure of the speaker cabinet becomes complicated and therefore a measure must be taken to secure dust proofing, leading to an increase in the cost of the sound system.

SUMMARY OF THE INVENTION

The present invention has been made to solve the above and other problems to provide a sound control unit for implementing good bass reproduction characteristics with a small-sized, lightweight and inexpensive speaker system.

Further, an object of the present invention is to provide a small-sized, lightweight and inexpensive sound system for implementing good bass reproduction characteristics with a small-sized, lightweight and inexpensive speaker system.

In order to attain the above and other objects, a sound control unit according to the present invention comprises signal generating means for generating a feedback signal in response to an input of a vibration detecting signal from a vibration detecting coil which detects vibrations of a vibration member of a speaker; and signal control means for controlling, by the feedback signal, a sound signal inputted to a driving voice coil of the speaker.

Further, a sound system according to the present invention comprises a speaker unit having fixed to predetermined positions of the vibration member a driving voice coil for driving a vibration member in response to an inputted sound signal, and a vibration detecting coil for detecting a vibration of the vibration member to generate a vibration detecting signal; sound signal output means which applies a signal processing to a sound source signal inputted from a predetermined sound source to output a sound signal inputted to the driving voice coil; and sound control means for controlling the sound signal outputted from the sound signal output means by a feedback signal generated in response to the input of the vibration detecting signal from the vibration detecting coil so as to input the sound signal to the driving voice coil.

Therefore, according to the present invention, by controlling a minimum resonance frequency and a Q factor of the resonance characteristic, good bass reproduction characteristics can be implemented with a small-sized, lightweight and inexpensive speaker system.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF A PREFERRED EMBODIMENT

First Embodiment

Figure 1:
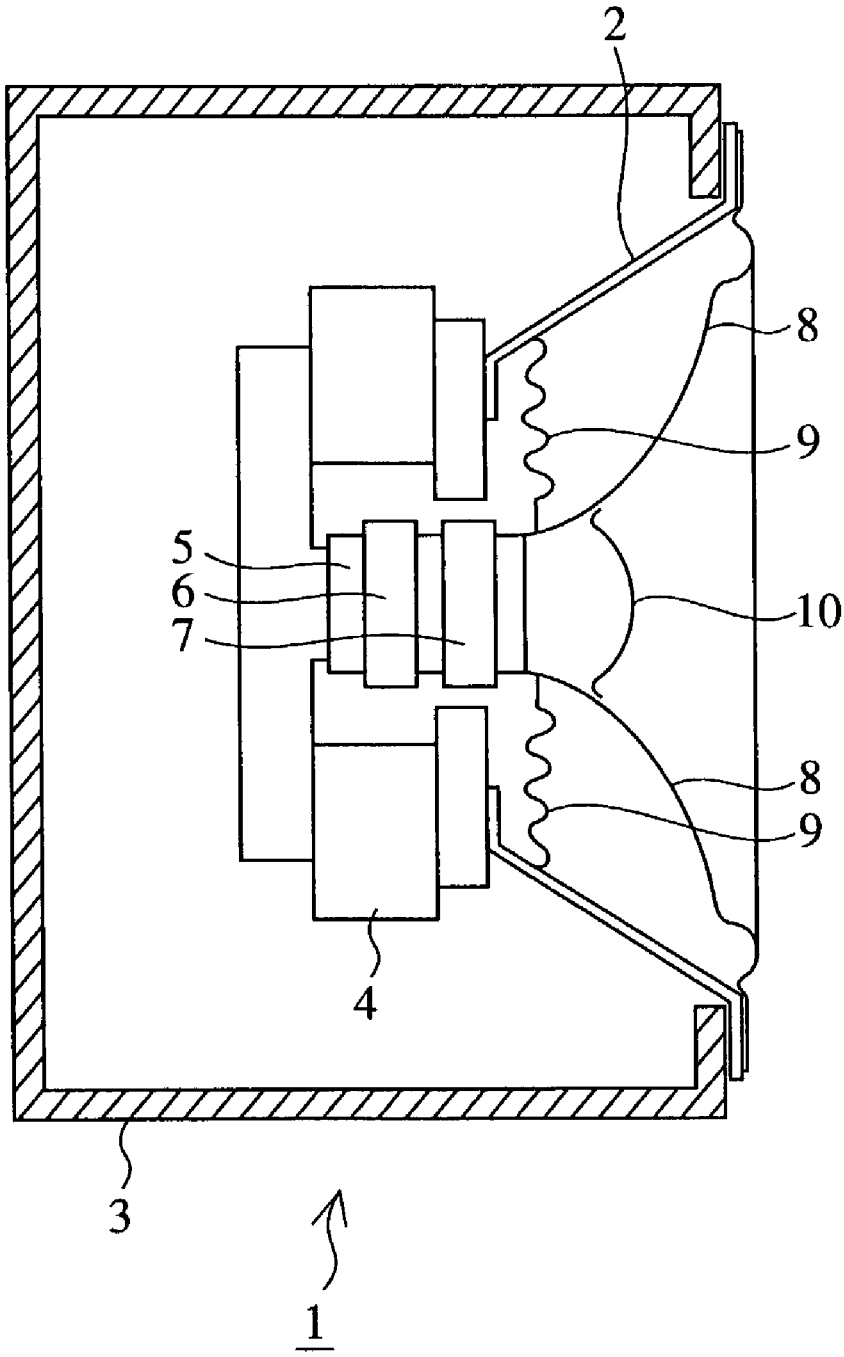
FIG. 1 is a sectional view showing the structure of a speaker system according to a first embodiment of the present invention.

FIG. 1 shows the structure of a speaker system which is used in a sound system to which a sound control unit according to the first embodiment of the present invention is applied.

Referring to FIG. 1, reference numeral 1 denotes a speaker system, reference numeral 2 a speaker unit, reference numeral 3 a cabinet to enclose therein the speaker unit 2, reference numeral 4 a magnetic circuit of the speaker unit 2, reference numeral 5 a cylindrical coil bobbin (vibration member) disposed inside a gap of the magnetic circuit 4 so as to be movable in a back and forth direction (in the right and left direction as seen in FIG. 1), reference numeral 6 a driving voice coil fixed to the coil bobbin 5, reference numeral 7 a vibration detecting coil fixed to the coil bobbin 5, reference numeral 8 a diaphragm coupled to the coil bobbin 5, reference numeral 9 a damper for damping the vibration of the vibration plate 8, and reference numeral 10 a dust cap.

A pair of lead wires (not shown) are provided for connecting the driving voice coil 6 and the vibration detecting coil 7 to terminals provided in the cabinet 3.

Figure 2:
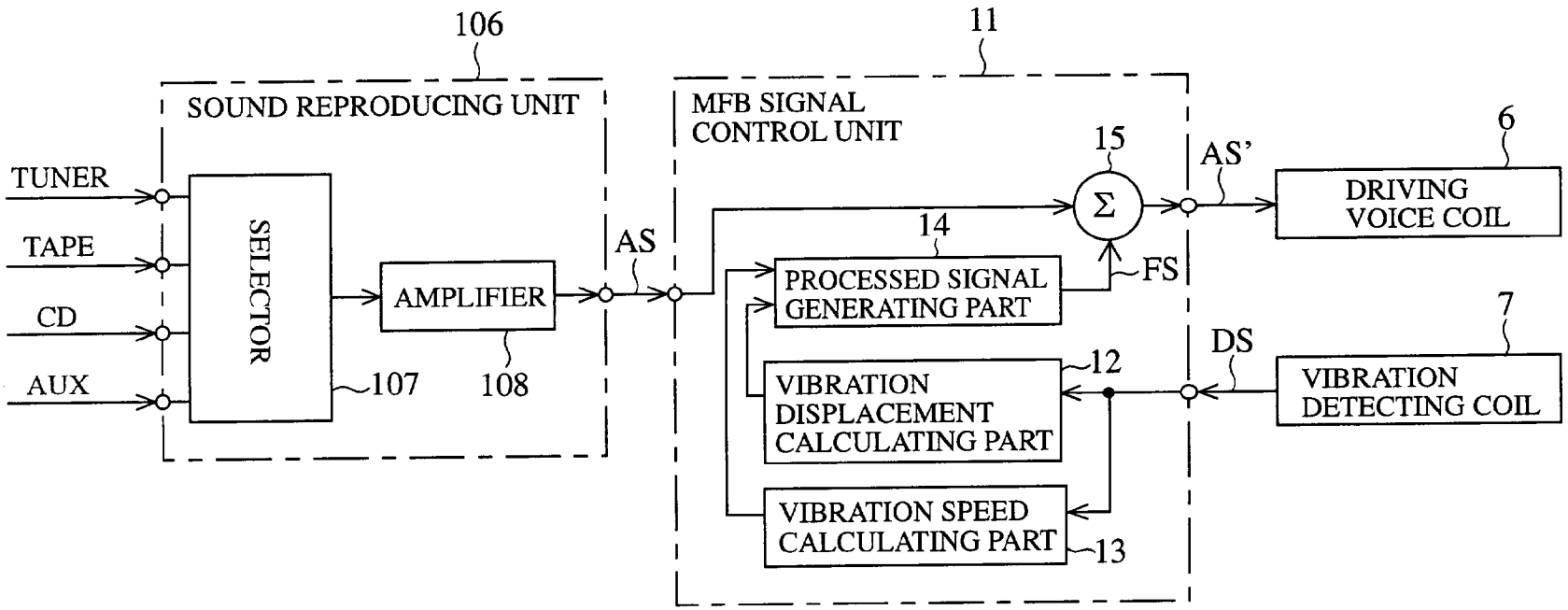
FIG. 2 is a block diagram showing a sound system configuration to which an MFB signal control unit according to a first embodiment is applied.
Figure 7:
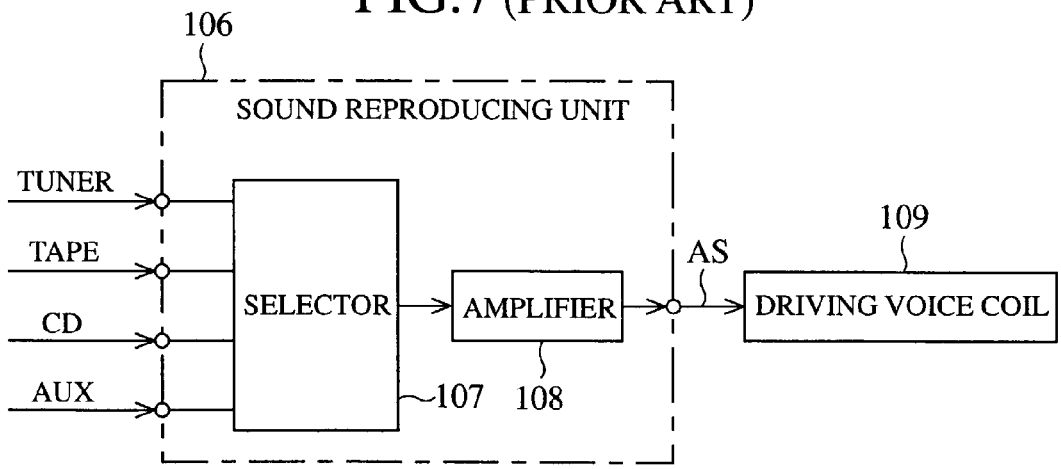
FIG.7 (PRIOR ART)
FIG. 7 is a block diagram showing a sound reproducing unit configuration in the conventional sound system.
Figure 8:
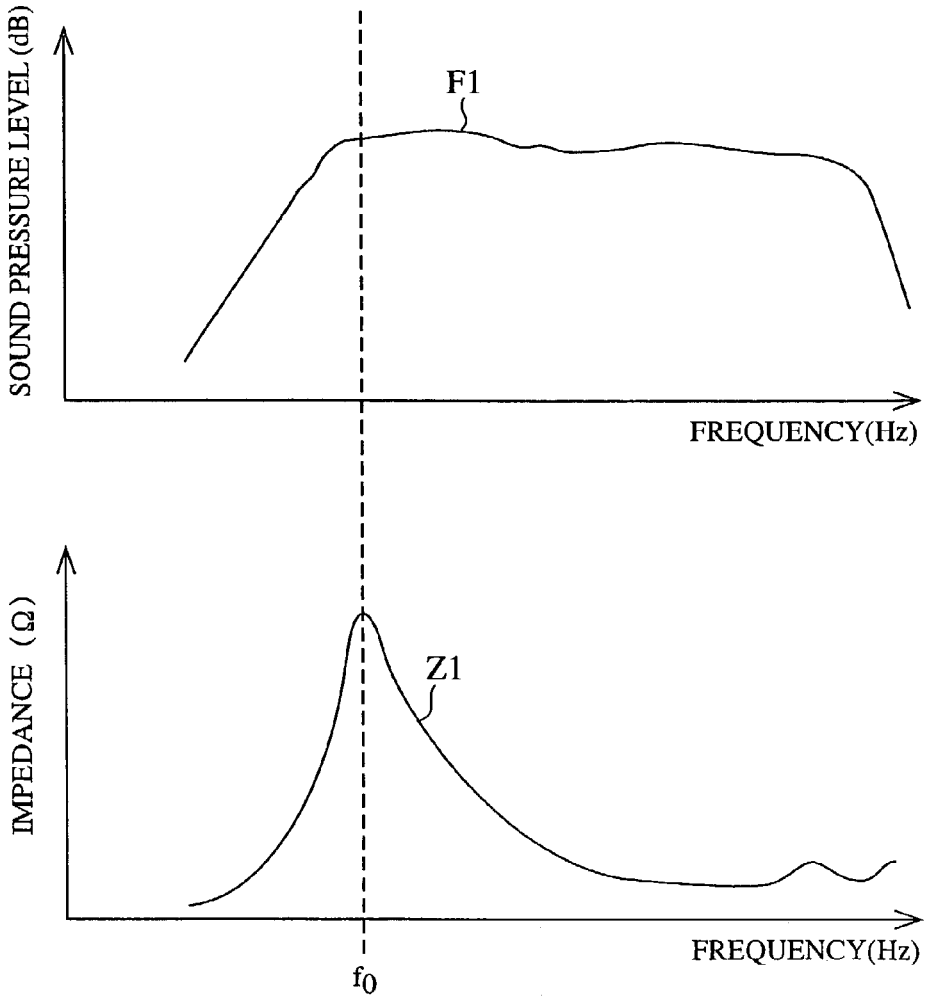
FIG.8 (PRIOR ART)
FIG. 8 is a graph showing the characteristics of a speaker unit in the conventional sound system.

FIG. 2 is a block diagram showing a system for connecting together the conventional sound reproducing unit shown in FIG. 7 and the speaker system 1 shown in FIG. 1.

Referring to FIG. 2, reference numeral 11 denotes a motional feedback (MFB) signal control unit (sound control means) which constitutes the sound control unit of the present invention, reference numeral 12 a vibration displacement calculating part (vibration displacement detecting means, signal generating means), reference numeral 13 a vibration speed calculating part (vibration speed detecting means, signal generating means), reference numeral 14 a processed signal generating part (signal control means), and reference numeral 15 an adder for adding two signals (signal control means, mix means). The driving voice coil 6 and the vibration detecting coil 7 are the same as those shown in FIG. 1. Further, as explained in FIG. 7, reference numeral 106 denotes a sound reproducing unit, reference numeral 107 a selector, and reference numeral 108 an amplifier.

The operation of the sound reproducing unit of the first embodiment will then be described.

In the sound reproducing unit 106, various kinds of sound source signals (TUNER, TAPE, CD, AUX) are inputted to the selector 107 from a tuner, a cassette tape player, a CD player, and other sound source devices. The selector 107 selects one sound source out of these various kinds of sound sources in accordance with the selecting operation and inputs it to the amplifier 108. The amplifier 108 amplifies this sound source signal to output a sound signal (AS).

In the MFB signal control unit 11, the vibration displacement calculating part 12 calculates, in response to the input of the vibration detecting signal from the vibration detecting coil 7, the amount of displacement of the coil bobbin 5 in FIG. 1 by the amplitude of the vibration detecting signal, thereby generating a vibration displacement detecting signal. Further, the vibration speed calculating part 13 calculates, in response to the input of the vibration detecting signal from the vibration detecting coil 7, the displacement speed of the coil bobbin 5 by a value of differentiation of the vibration detecting signal, thereby generating a vibration speed detecting signal.

The processed signal generating part 14 receives an input of the vibration displacement detecting signal to generate a feedback signal for controlling a minimum resonance frequency, and receives an input of the vibration speed detecting signal to generate a feedback signal for controlling a Q factor indicative of a steepness of resonance characteristics of the minimum resonance frequency. After mixing the generated two feedback signals, a built-in amplifier (not shown) performs amplification, attenuation, or the like, and thereafter the feedback signal (FS) is inputted to one terminal of the adder 15. The sound signal (AS) outputted from the sound reproducing unit 106 is inputted to the other terminal of the adder 15. The adder 15 outputs a sound signal AS' which is obtained by mixing the sound signal AS with the feedback signal FS inputted from the processed signal generating part 14, and inputs the sound signal AS' to the driving voice coil 6.

As a result, by the Fleming's left-hand rule, the coil bobbin 5 to which the driving voice coil 6 is fixed vibrates. Then, the diaphragm 8 connected to the coil bobbin 5 is vibrated to produce a sound. Further, by the Fleming's right-hand rule, as a result of vibration of the coil bobbin 5, an induced current is generated in the vibration detecting coil 7. The amplitude of this vibration detecting signal is nearly proportional to the amount of displacement of the coil bobbin 5, and the value of differentiation (a rate of change) of the amplitude detecting signal is nearly proportional to the speed of vibration of the coil bobbin 5.

Figure 3:
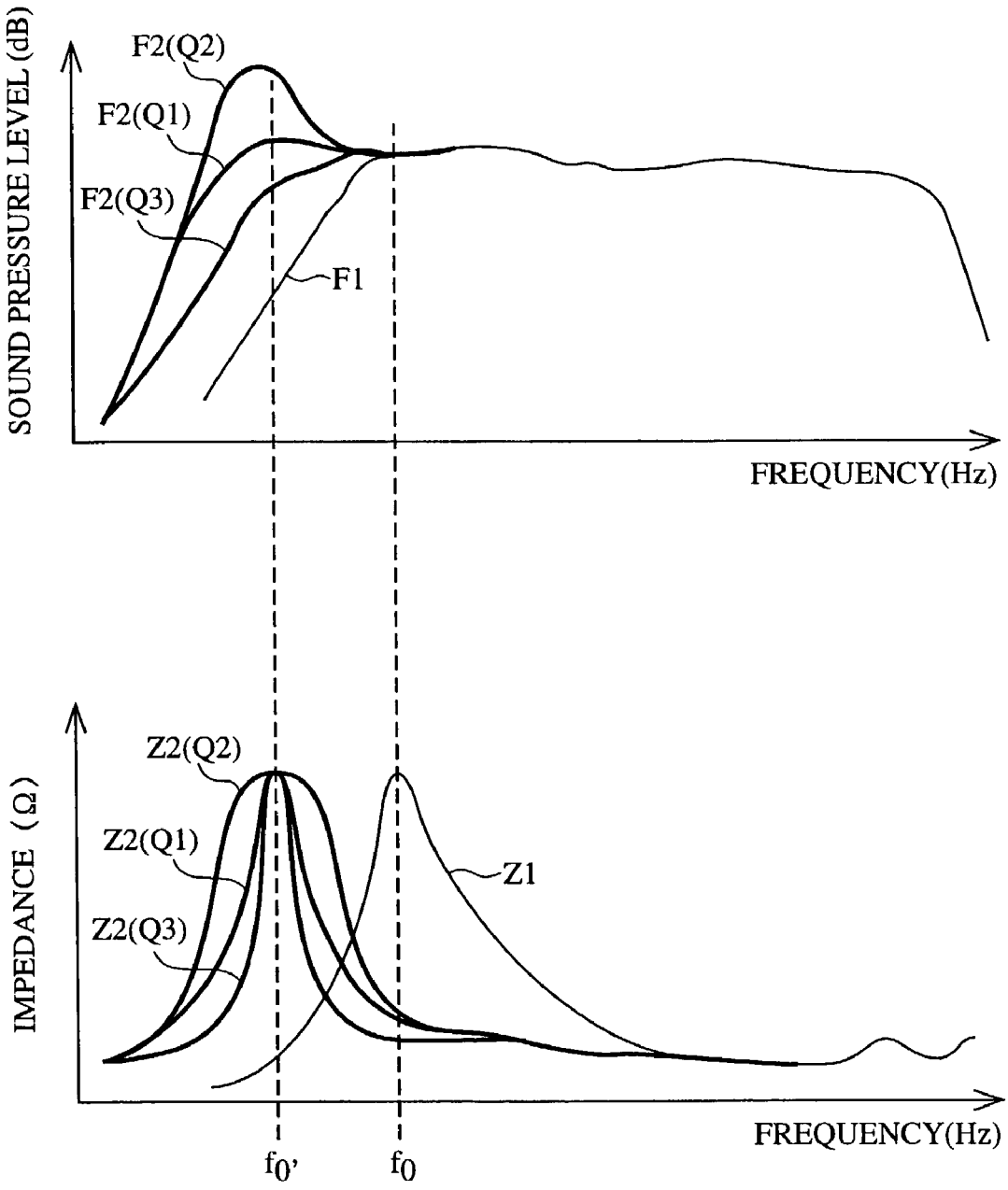
FIG. 3 is a graph showing the characteristics of a speaker unit according to a first embodiment.

FIG. 3 is a graph showing an example of sound characteristics of a speaker system when the MFB signal control unit 11 in FIG. 2 is applied to the sound system for the bus. In FIG. 3, the three curves in the upper-side graph are output sound pressure level frequency characteristics F2 (Q1), F2 (Q2), F2 (Q3), and the three curves Z2 (Q1), Z2 (Q2), Z2 (Q3) in the lower-side graph are impedance characteristics having the output sound pressure level frequency characteristics. Reference character f0' denotes a minimum resonance frequency. In FIG. 3, the portions indicated by thick lines are intended for emphasis for the purpose of comparison between the conventional output pressure sound level frequency characteristic F1 and the impedance characteristic Z1.

In case the MFB signal control unit 11 is applied, a minimum resonance frequency f0' is controlled by the feedback signal for controlling the minimum resonance frequency which is generated in response to the vibration displacement detecting signal, so as to lower the minimum resonance frequency f0' to the bass region than the conventional minimum resonance frequency characteristic f0. Therefore, the bass characteristics of the portions of the output sound pressure level frequency characteristics F2 (Q1), F2 (Q2), F2 (Q3) indicated by thick lines are improved as compared with that of the conventional output sound pressure level frequency characteristic F1 as shown by a thin line. Further, by means of the feedback signal for controlling the Q factor of the resonance characteristics generated in response to the vibration speed detecting signal, the steepness in the waveform of the impedance characteristics Z2 (Q1), Z2 (Q2), Z2 (Q3) indicated by thick lines having resonance characteristics are controlled, so that the rising characteristics (so-called shoulder characteristics) of the output sound pressure frequency characteristics F2 (Q1), F2 (Q2), F2 (Q3) are controlled.

Therefore, by performing the optimum control considering the entire system, good bass reproduction characteristics can be implemented with a small-sized, lightweight and inexpensive speaker system. In this case, the appropriately designed circuit factor of the MFB signal control unit 11 implements the good bass reproduction characteristics and the radiation of noiseless sound over the entire frequency range.

As described above, according to the first embodiment, the minimum resonance frequency and the Q factor of the resonance characteristics are electrically controlled by mixing the sound signal to be outputted from the conventional sound reproducing unit 106 with the feedback signal. Therefore, good bass reproduction characteristics can be implemented with a small-sized, lightweight and inexpensive speaker system without using a plurality of speaker units in a single speaker system (in a single cabinet) and without widening the inner space thereof.

In addition, according to the first embodiment, good bass reproduction characteristics can be implemented with a small-sized, lightweight and inexpensive speaker system by electrical processing in accordance with the vibration displacement and the vibration speed of the vibration member.

Further, by an appropriate control considering the entire system, good bass reproduction characteristics can be implemented with a small-sized, lightweight and inexpensive speaker system.

Still further, since the adder 15 adds the sound signal outputted from the sound reproducing unit 106 to the feedback signal outputted from the processed signal generating part 14, good bass reproduction characteristics can be implemented by a simple, small-sized, lightweight and inexpensive speaker system.

Figure 4:
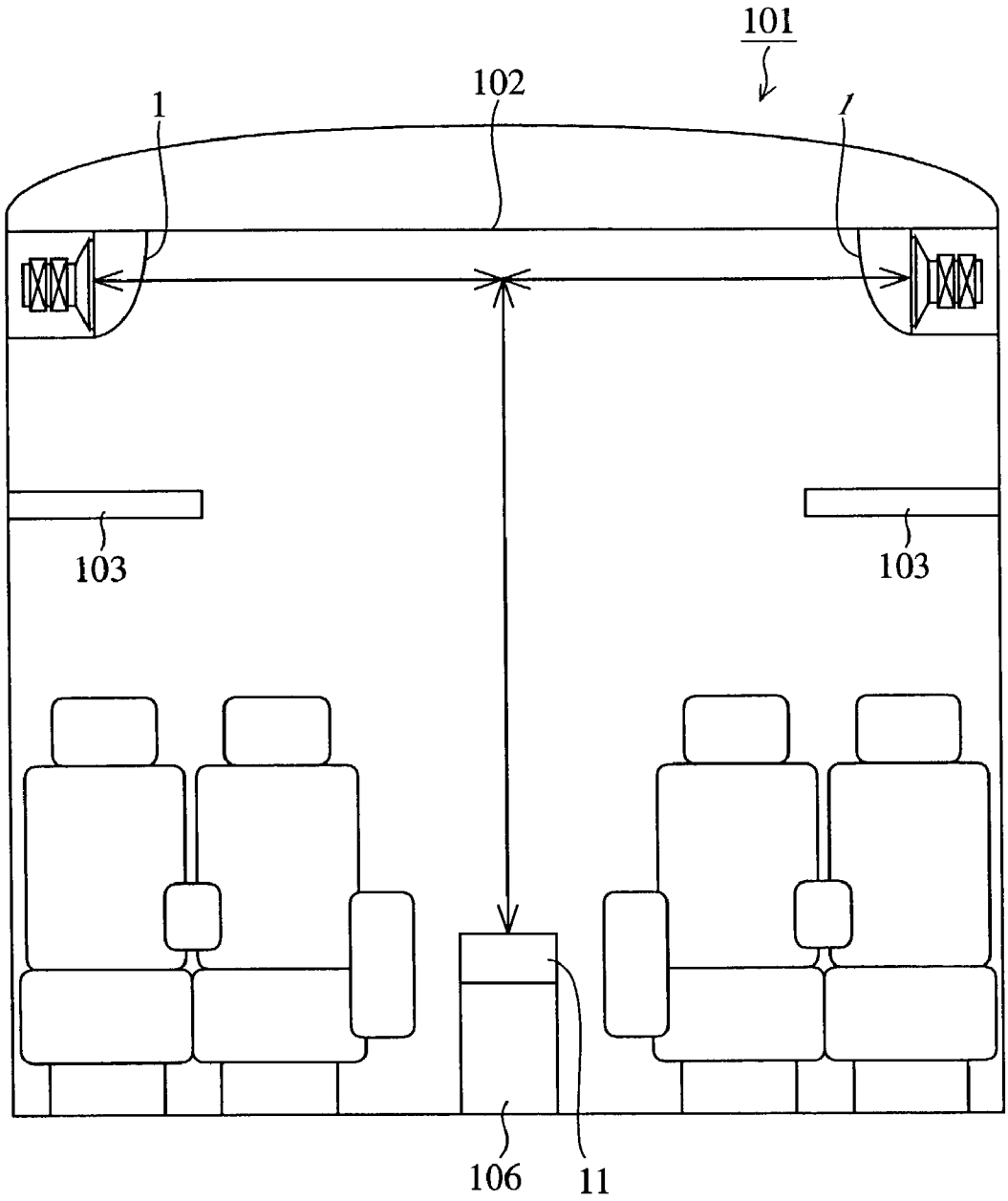
FIG. 4 is a schematic diagram showing the sound system configuration for a bus to which the MFB signal control unit according to a first embodiment is applied.
Figure 5:
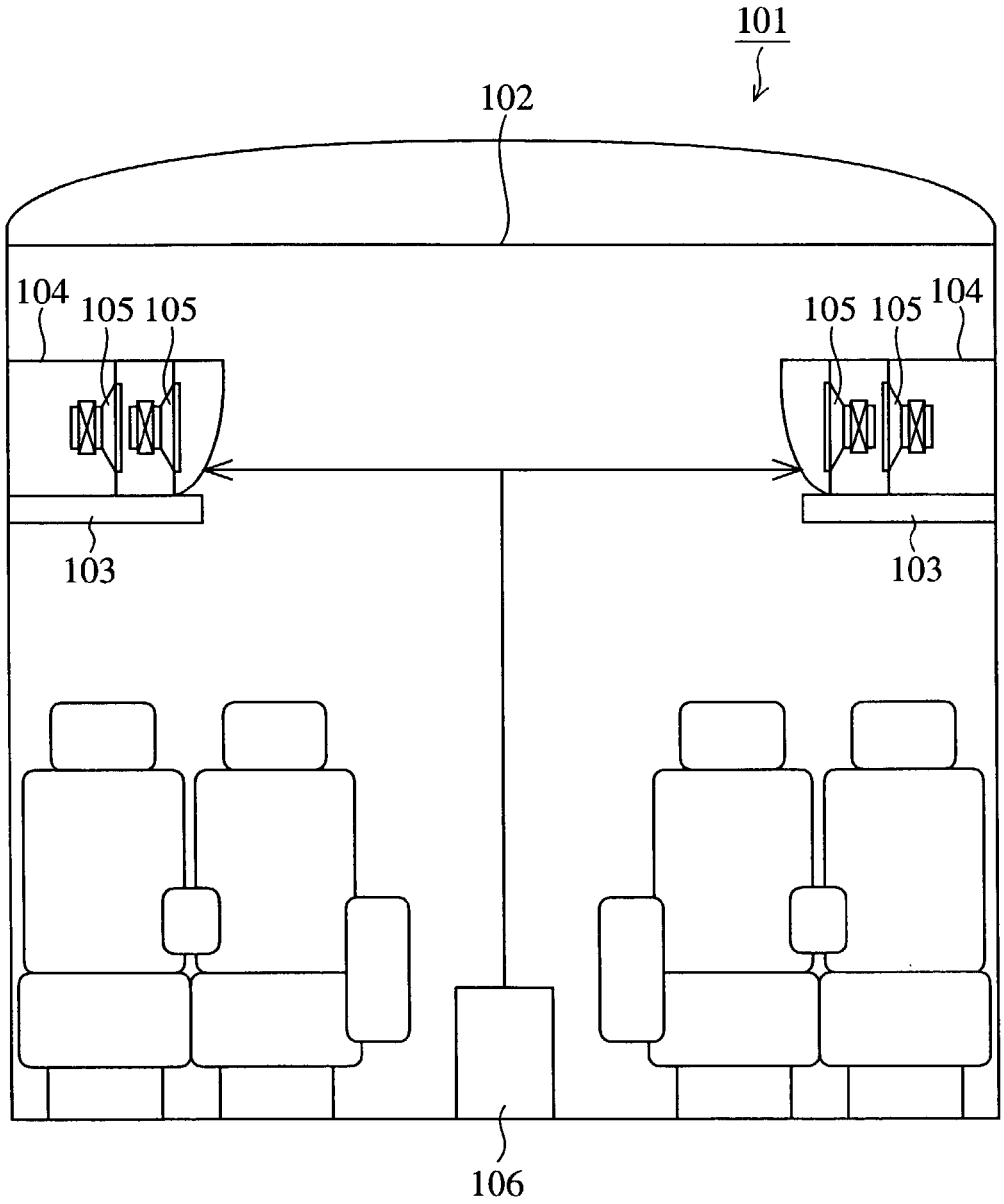
FIG.5 (PRIOR ART)
FIG. 5 is a schematic diagram showing an arrangement of the conventional sound system for a bus.
Figure 6A:
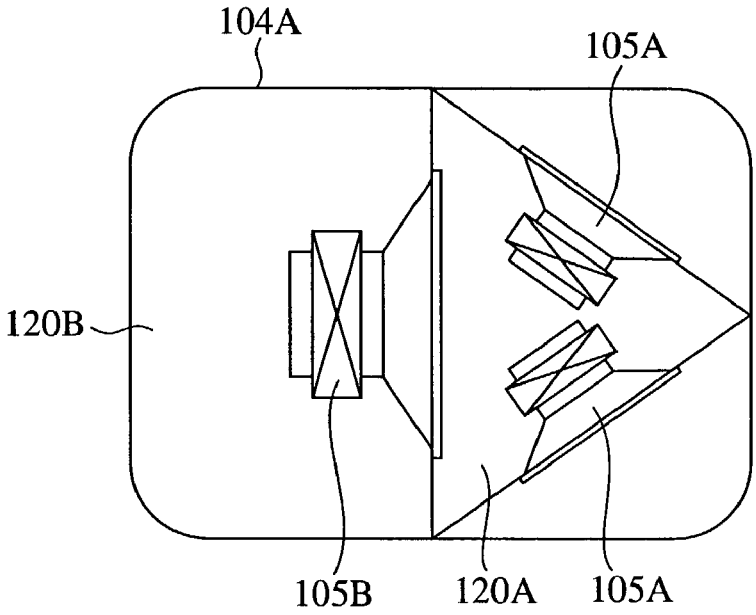
FIG.6A (PRIOR ART)
FIGS. 6A and 6B are schematic sectional views showing the structure of conventional speaker systems.
Figure 6B:
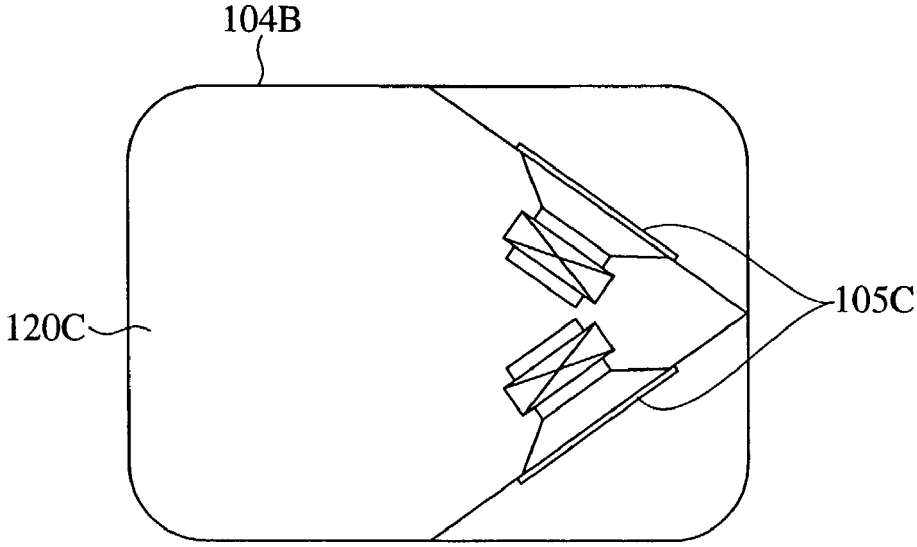
FIG.6B (PRIOR ART)

By adding the MFB signal control unit 11 to the sound reproducing unit 106 in the conventional sound system for the bus, as shown in FIG. 4, for example, it becomes possible to mount a small-sized and lightweight speaker system 1 on the ceiling 102 inside the bus body 101. As a result, more spacious room is created in the rack 103, so that it becomes possible to mount passengers' baggage or the crew's belongings thereon or to dispose another system in the space. In this case, it is not necessary to work the conventional sound reproducing unit 106, but need only to change the connection thereto. This easily modifies the conventional sound system for the bus to implement the good bass reproduction characteristics.

Second Embodiment

While in the above-described first embodiment, an arrangement has been taken that the MFB signal control unit 11 is added to the sound reproducing unit 106 in the conventional sound system for the bus, in the second embodiment, the conventional sound reproducing unit 106 is modified to newly construct the sound system of the present invention.

For example, the sound source signal outputted from the selector 107 of the sound reproducing unit 106 in FIG. 2 is inputted to one terminal of the adder 15. The sound signal outputted from the adder 15 after mixing it with the feedback signal generated by the MFB signal control unit 11 is returned to the amplifier 108 of the sound reproducing unit 106. Then, the sound signal outputted from the amplifier 108 is inputted to the driving voice coil 6. Alternatively, the MFB signal control unit 11 is built into the conventional sound reproducing unit 106 to newly construct the sound system. In other words, the sound system is constructed inclusive of the sound signal output means (corresponding to the sound reproducing unit 106) which outputs the sound signal by applying the signal processing to the sound source signal. The operation of this sound system is the same as that in the first embodiment.

As described above, according to the second embodiment, an arrangement is made so that the feedback signal generated by the sound control means (MFB signal control unit 11) is mixed with the sound signal from the sound signal output means, and that the minimum resonance frequency and the Q factor of the resonance characteristics are electrically controlled. Therefore, without using a plurality of speaker units in a single speaker system, and without widening the inner space thereof, good bass reproduction characteristics can be implemented by a small-sized, lightweight and inexpensive speaker system. Besides, the second embodiment exerts the same effects as the first embodiment.

In each of the above-described embodiments, the vibration detecting coil 7 of the speaker unit is electromagnetically coupled to the magnetic circuit of the speaker unit within a range of displacement of the coil bobbin 5, and fixed to the position where a vibration detecting signal is generated. Therefore, even in case where the amplitude of the sound signal and the displacement of the coil bobbin 5 become maximum, the vibration detecting coil 7 generates the vibration detecting signal. Thus, there is no such possibility that the feedback loop of the sound system will come off, causing oscillations, or the like.

While in each of the above-described embodiments, a description has been made about the sound system for a bus and about the sound control unit which is applied to the sound system, the range of application of the present invention is not limited to the above-described embodiments. Naturally, it is needless to say that the sound control unit and the sound system according to this invention are applicable to mobile bodies such as vehicles other than a bus, ships, airplanes, or the like, and also to the systems for indoor facilities for other than mobile bodies.

It is readily apparent that the above-described sound control unit and the sound system meet all of the objects mentioned above and also have the advantage of wide commercial utility. It should be understood that the specific form of the invention herein above described is intended to be representative only, as certain modifications within the scope of these teachings will be apparent to those skilled in the art.

Accordingly, reference should be made to the following claims in determining the full scope of the invention.

What is claimed is:

1. A sound control unit comprising:

a signal generator for generating a feedback signal in response to an input of a vibration detecting signal from a vibration detecting coil which detects vibrations of a vibration member of a speaker, the signal generator including a vibration displacement detector and vibration speed detector; and a signal controller for controlling, by the feedback signal, a sound signal inputted to a driving voice coil of the speaker in response to a vibration displacement detecting signal and a vibration speed detecting signal each respectively received from said vibration displacement detector and said vibration speed detector, wherein said signal controller controls a minimum resonance frequency of the speaker in response to the vibration displacement detecting signal, and controls a Q factor of resonance characteristics of the minimum resonance frequency in response to the vibration speed detecting signal.

2. The sound control unit according to claim 1, wherein said vibration displacement detector detects a vibration displacement in response to the input of the vibration detecting signal to generate said vibration displacement detecting signal, and said vibration speed detector detects a vibration speed of said vibration member in response to the input of the vibration detecting signal to generate said vibration speed detecting signal.

3. The sound control unit according to claim 2, wherein said signal controller includes a signal mixer for mixing a feedback signal generated in response to the vibration displacement detecting signal and the vibration speed detecting signal with the sound signal which is inputted to the driving voice coil of the speaker.

4. A sound system comprising:

a speaker unit having fixed to predetermined positions of the vibration member a driving voice coil for driving a vibration member in response to an inputted sound signal, and a vibration detecting coil for detecting a vibration of the vibration member to generate a vibration detecting signal;

sound signal output device which applies a signal processing to a sound source signal inputted from a predetermined sound source to output a sound signal inputted to said driving voice coil; and a sound controller including a vibration displacement detector that produces a vibration displacement detecting signal and a vibration speed detector that produces a vibration speed detecting signal for controlling the sound signal, in response to said vibration displacement detecting signal and said vibration speed detecting signal, outputted from said sound signal output device by a feedback signal generated in response to the input of the vibration detecting signal from said vibration detecting coil so as to input the sound signal to said driving voice coil, wherein said sound controller controls a minimum resonance frequency of the speaker unit in response to the vibration displacement detecting signal, and controls a Q factor of a resonance characteristic of the minimum resonance frequency in response to the vibration speed detecting signal.

5. The sound system according to claim 4, wherein said vibration detecting coil is fixed to a position for generating the vibration detecting signal by electromagnetically connecting it with a magnetic circuit of said speaker unit within a range of displacement of said vibration member.

6. The sound system according to claim 5, wherein said vibration displacement detector detects the vibration displacement of the vibration member in response to the input of the vibration detecting signal to generate the vibration displacement detecting signal;

and said vibration speed detector detects the vibration speed of the vibration member in response to the input of the vibration detecting signal to generate the vibration speed detecting signal.

7. The sound system according to claim 6, wherein said signal controller includes a signal mixer for mixing the control signal generated in response to the vibration displacement detecting signal and the vibration speed detecting signal with the sound signal outputted from said sound signal output means so as to input the sound signal to the driving voice coil.

* * * * *